United States Patent [19]

Alba

[11] Patent Number: 4,783,971

[45] Date of Patent: Nov. 15, 1988

[54] REFRIGERATOR DRAIN PAN APPARATUS

[75] Inventor: Donald Alba, Marengo, Iowa

[73] Assignee: Amana Refrigeration, Inc., Amana, Iowa

[21] Appl. No.: 153,744

[22] Filed: Feb. 8, 1988

[51] Int. Cl.[4] ..... F25D 21/14

[52] U.S. Cl. ..... 62/291; 248/225.1; 312/348; 312/350

[58] Field of Search ..... 62/291, 285, 279; 248/225.1, 311.2; 312/270, 348, 350

[56] References Cited

U.S. PATENT DOCUMENTS

| | | | |
|---|---|---|---|
| 2,021,065 | 11/1935 | Hurlburt | 248/311.2 |
| 2,293,210 | 8/1942 | Marzolf | 312/348 X |
| 2,723,533 | 11/1955 | Mann | 62/279 X |
| 4,108,519 | 8/1978 | Chewenak | 312/350 X |
| 4,121,878 | 10/1978 | Lokken | 312/348 X |
| 4,241,668 | 12/1980 | Carroll | 312/270 X |
| 4,440,461 | 4/1984 | Powell et al. | 312/348 X |
| 4,729,613 | 3/1988 | Tromble et al. | 312/270 |

*Primary Examiner*—William E. Tapolcai, Jr.
*Attorney, Agent, or Firm*—William R. Clark; Richard M. Sharkansky

[57] ABSTRACT

Refrigerator drain pan apparatus including a pair of spaced mounting brackets having longitudinal guide slots for receiving in sliding engagement the longitudinal rims of the drain pan. The brackets also have clamps for securely engaging gripper pads on the rims of the drain pan at the operating position for eliminating vibration noise. The guide slots include a rim support shelf and a parallel top panel space thereabove. Forward extending ramps guide the drain pan rims up into the guide slots. The clamps include V-shaped tabs positioned in front and back of the guide slots, which tabs extend below the plane of the top panel and engage the gripper pads in an interference fit at the operating position. The pan also has bumpers protruding from the rims to engage the front V-shaped path at the operating position of the drain pan thereby providing a stop. An upward cone in the pan bottom provides a drip area for incoming water.

12 Claims, 5 Drawing Sheets

FIG. 3
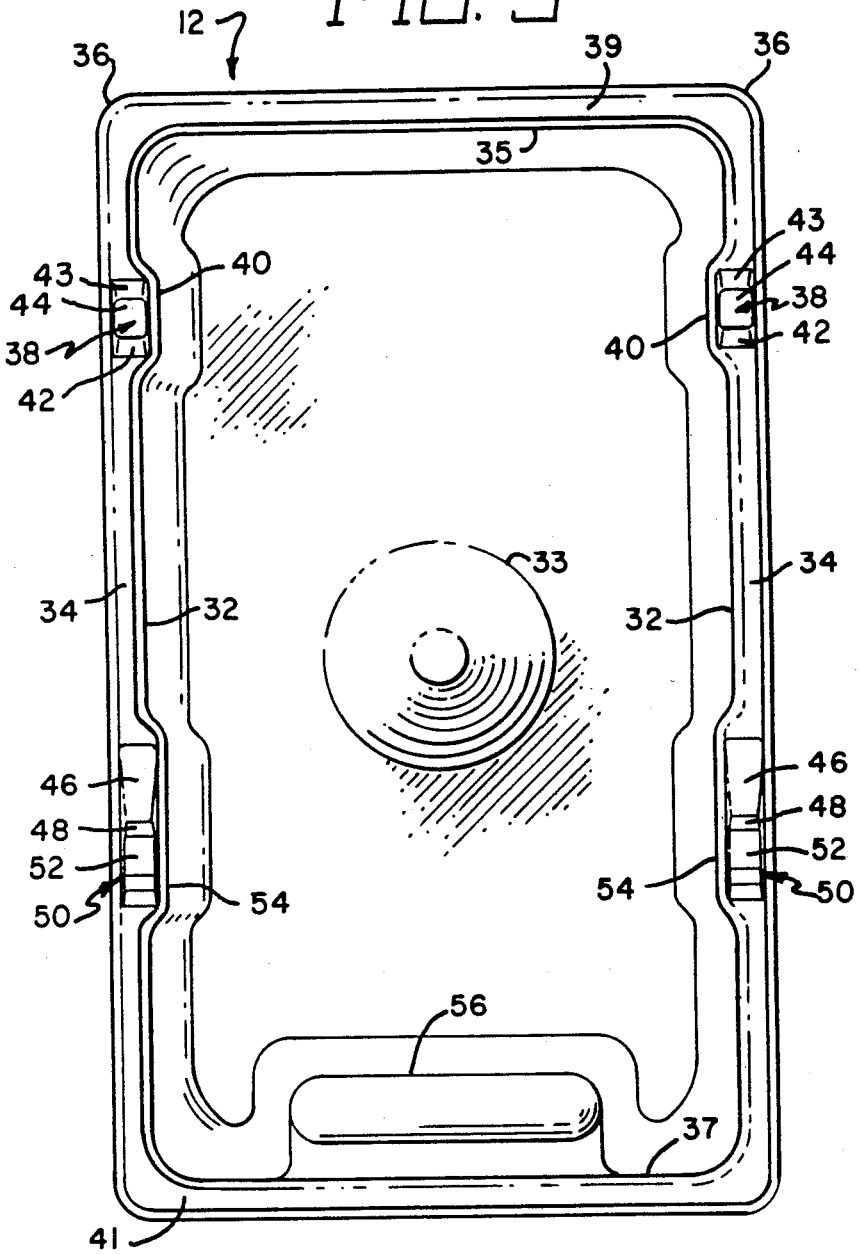
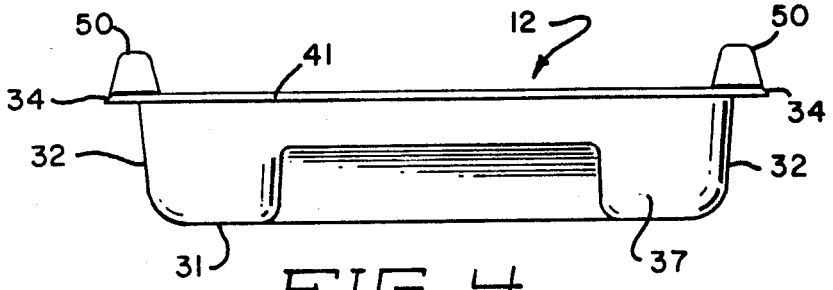
FIG. 4

REFRIGERATOR DRAIN PAN APPARATUS

BACKGROUND OF THE INVENTION

The field of the invention generally relates to refrigeration devices that have a defrost cycle, and more particularly relates to drain pan apparatus for such devices.

As is well known, refrigeration devices generally have a refrigeration loop including a compressor, condenser, expansion valve, and evaporator. It is also well known that ice or frost tends to form on the outside of the evaporator, and such ice interferes with the thermal transfer of heat to the evaporator. Accordingly, in order to remove the ice, many refrigerators have a periodic defrost cycle wherein an electric heating element proximate to the evaporator is activated during an off cycle of the compressor. The water formed by melting the ice then flows through a drain hose to a drain pan which typically is positioned on top of the condenser coils at the bottom of the refrigerator.

Water in the drain pan evaporates at a long-term rate that is faster than the inflowing rate of new defrost water, so the drain pan never needs emptying during normal operation. Nevertheless, there is a general requirement that the drain pan not be rigidly affixed in place because there are occasions when it is desirable to remove the drain pan. For example, if the refrigerator is being moved from one location to another, the drain pan is generally removed because water in the drain pan could spill as a result of the motion; such spilling would be inevitable if the refrigerator was tipped onto a dolly, as is often the case. Also, it is desirable to clean the condenser periodically, and the normal procedure is to remove a lower front grill and then remove the drain pan to expose the condenser coils underneath.

Prior art drain pans sit loosely on top of the condenser. This arrangement has the advantage of not requiring any critical alignment, and therefore the drain pans have been relatively easy to remove and replace even though they are awkwardly positioned close to the floor. However, refrigerators tend to have some vibration caused by the compressor, and such vibration commonly results in the drain pan rattling.

SUMMARY OF THE INVENTION

It is an object of the invention to provide a defrost drain pan that is securely clamped in place so as to eliminate rattling caused by vibration. A further object is to provide such a drain pan that can be readily removed and replaced without complicated alignment.

Another object of the invention is to provide a drain pan that readily aligns for insertion, and has a positive stop for seating the drain pan in a predetermined location above the condenser. It is also an object to provide an air gap between the bottom of the drain pan and the condenser.

A further object is to reduce or eliminate the noise of dripping water.

It is also an object to provide a drain pan that is stabilized during removal so as to prevent tipping that could spill water. It is a further object to provide a drain pan that is easy to clasp for removal.

The foregoing and other objects are provided by apparatus for collecting water formed by melting ice during a refrigerator defrost cycle, comprising a drain pan comprising a bottom, side walls, a back wall, and a front wall, and means for supporting the drain pan in an elevated operating position for receiving the water, the supporting means comprising guide slots for slidably removing and replacing the drain pan, the supporting means further comprising means for clamping the drain pan in the operating position for preventing vibration noise. It may be preferable that the drain pan further comprise rims extending outwardly from the side walls, the guide slots being adapted for receiving the rims in sliding engagement. It may also be preferable that the rims have pads and the clamping means comprise means for engaging the pads in an interference fit at the operating position. It is further preferable that the apparatus comprise a stop for preventing the drain pan from being slid in the guide slots back past the operating position. Further, the apparatus may preferably comprise an upward protrusion on the bottom of the drain pan directly below the outlet of the drain hose wherein water dripping from the drain hose drips onto the protrusion and then runs down into the water collected in the drain pan.

BRIEF DESCRIPTION OF THE DRAWINGS

The foregoing objects and advantages will be more fully understood by reading the Description of the Preferred Embodiment with reference to the drawings wherein:

FIG. 3 is a top view of the drain pan;

FIG. 4 is a front view of the drain pan;

DESCRIPTION OF THE PREFERRED EMBODIMENT

Figure 1:
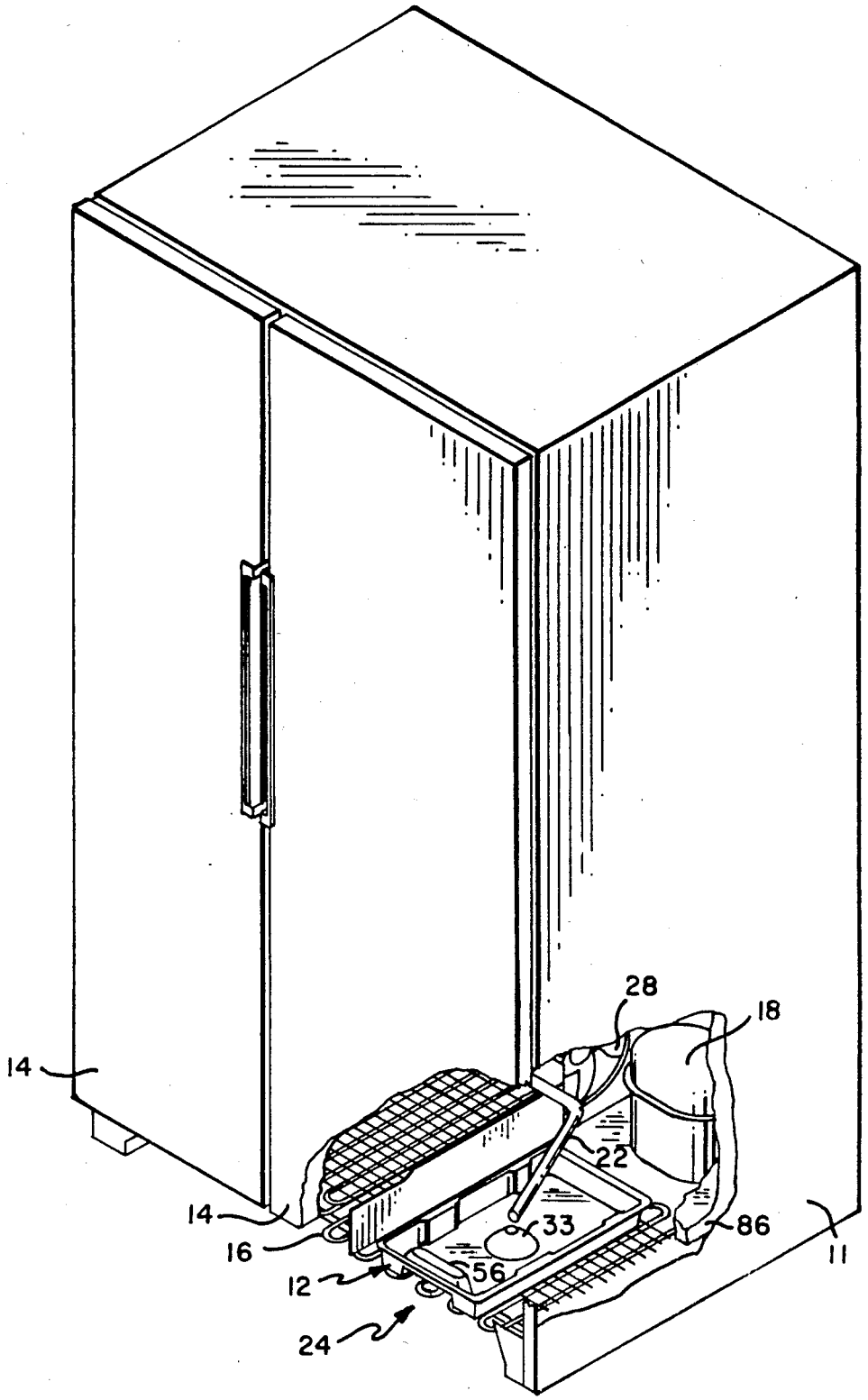
FIG. 1 is a front perspective view of a refrigerator with a portion broken-away showing the drain pan.
Figure 8:
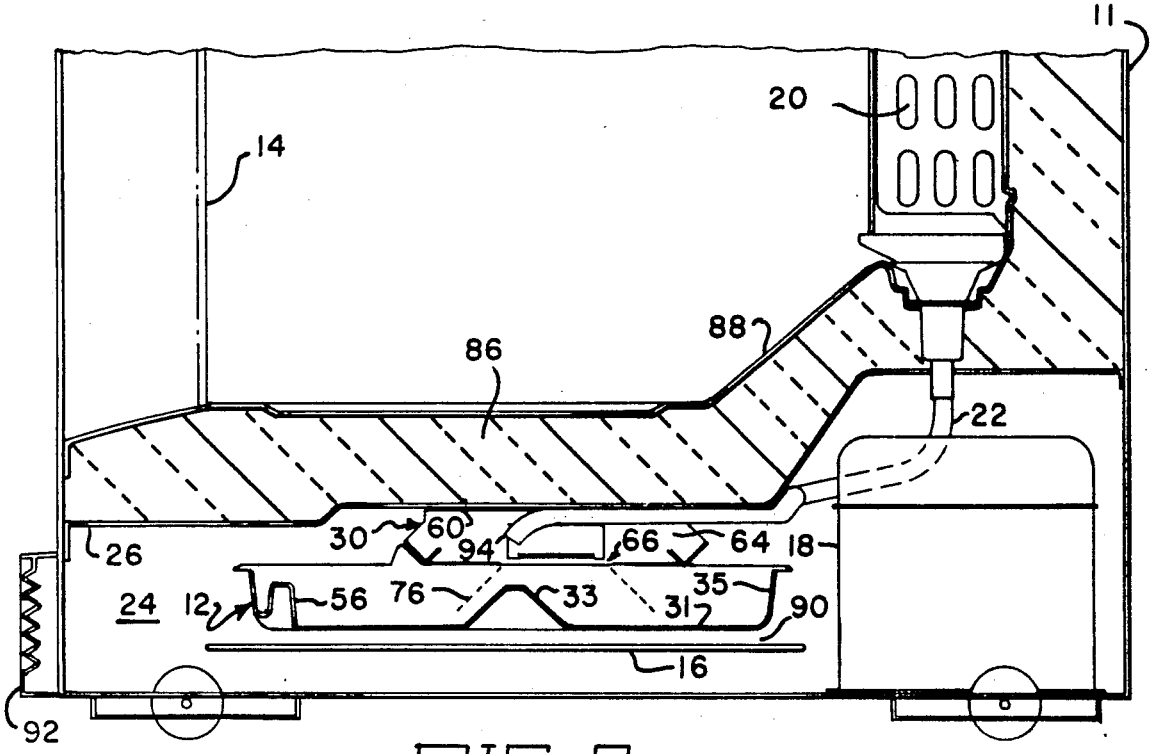
FIG. 8 is a side-sectioned view of the bottom of the refrigerator showing the drain pan apparatus.

Referring to FIG. 1, there is shown a perspective view of refrigerator 10 with a portion of the outer casing 11 broken away thus showing refrigerator drain pan 12. Although refrigerator 10 is here shown with adjacent vertical doors 14 in a so-called side-by-side model, those skilled in the art will understand that the invention can be used to advantage with other types of refrigerators and refrigeration devices that have a drain pan 12 for collecting water formed during a defrost cycle. As is conventional, refrigerator 10 has a refrigeration loop consisting of condenser 16, compressor 18, an expansion valve (not shown) and an evaporator 20 (FIG. 8). As is also conventional, refrigerator 10 periodically goes through a defrost cycle to remove frost collected on evaporator 20. More specifically, during a defrost cycle, compressor 18 is deactivated and a heating coil (not shown) proximate to evaporator 20 is energized to melt the ice or frost formed on the evaporator 20. The resulting water is then drained down drain hose 22 into refrigerator drain pan 12 positioned in a chamber 24 below the outer case bottom 26 (FIG. 8). A fan 28 is also positioned in chamber 24 and it functions to circulate air for cooling condenser 16 and compressor 18. The circulation of air across refrigerator drain pan 12 also increases the rate of evaporation of water in the drain pan 12.

Figure 2:
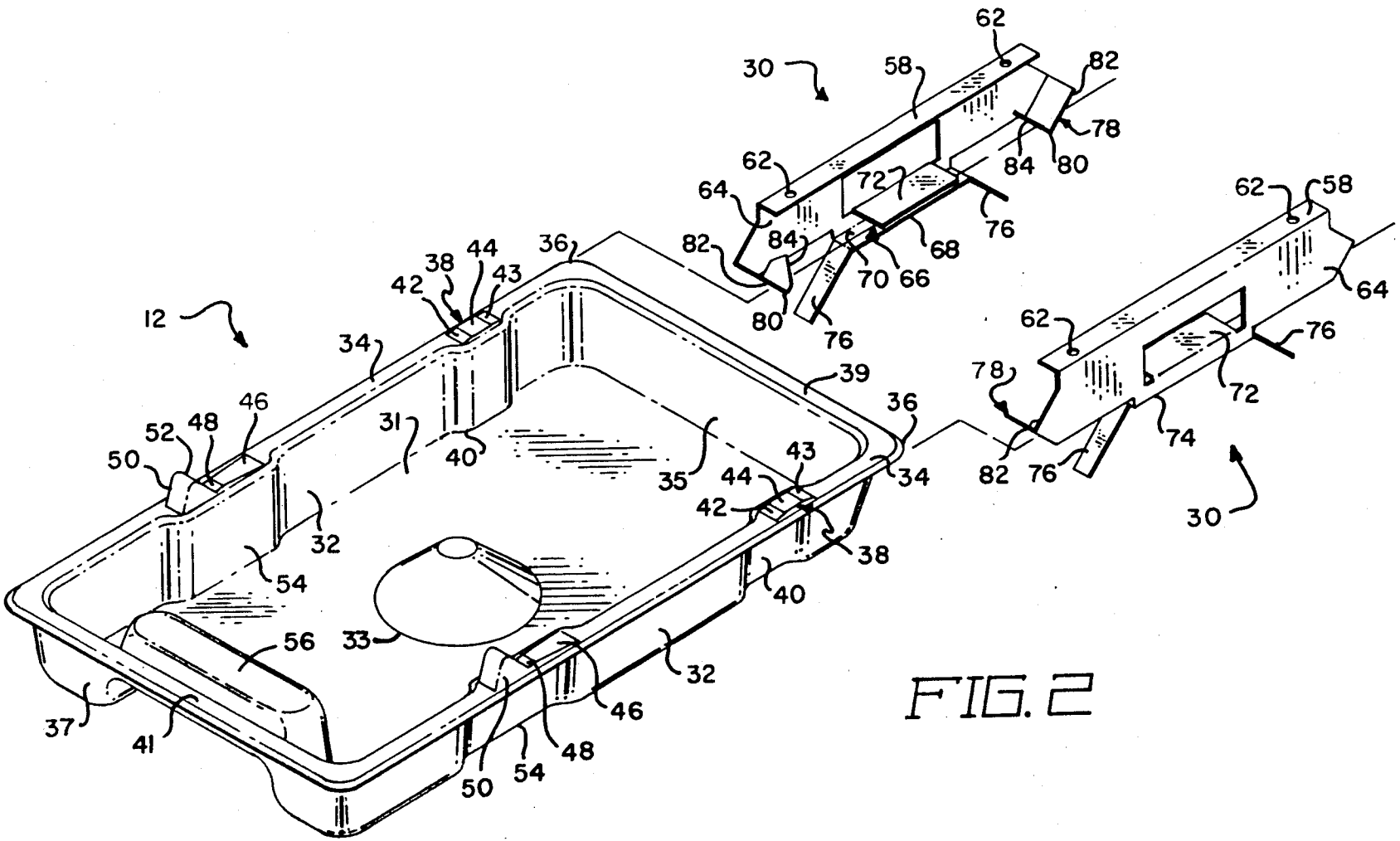
FIG. 2 is an exploded perspective view of the drain pan and its mounting brackets.

FIG. 2 shows an exploded perspective view of refrigerator drain pan 12 and drain pan mounting brackets 30 that securely support drain pan 12 in an elevated position within chamber 24. With further reference to FIGS. 3–6, drain pan 12 is a vacuum-formed plastic part that includes a bottom 31, two parallel opposing side walls 32, a back wall 35, and a front wall 37. Protruding upwardly from a central region of bottom 31 is cone 33, here shown as being truncated. Support rims 34 or lips extend outwardly in a horizontal direction from respective side walls 32, and rims 39 and 41 also extend outwardly in a horizontal direction from respective back wall 35 and front wall 37, respectively. Rims 34, 39, and 41 are all interconnected and rounded at corners 36.

Toward the rear of rims 34 are corresponding gripper pads 38 which are formed adjacent to side indentations 40. More specifically, gripper pads 38 have forward and backward inclined surfaces 42 and 43 rising up to respective platforms 44 that are elevated slightly above the horizontal plane of rims 34. Side indentations 40 enable gripper pads 38 to have a width greater than the rest of rims 34, while still providing a structure that can readily be vacuum formed. Toward the front of rims 34 are corresponding inclined surfaces 46 which rise toward the front and then longitudinally drop off to valleys 48 before bumpers 50 which have rear shoulder surfaces 52. Side walls 32 also have indentations 54 in the regions of inclined surfaces 46 and bumpers 50. Handle 56 is formed from the bottom 31 adjacent to front wall 37.

Figure 5:
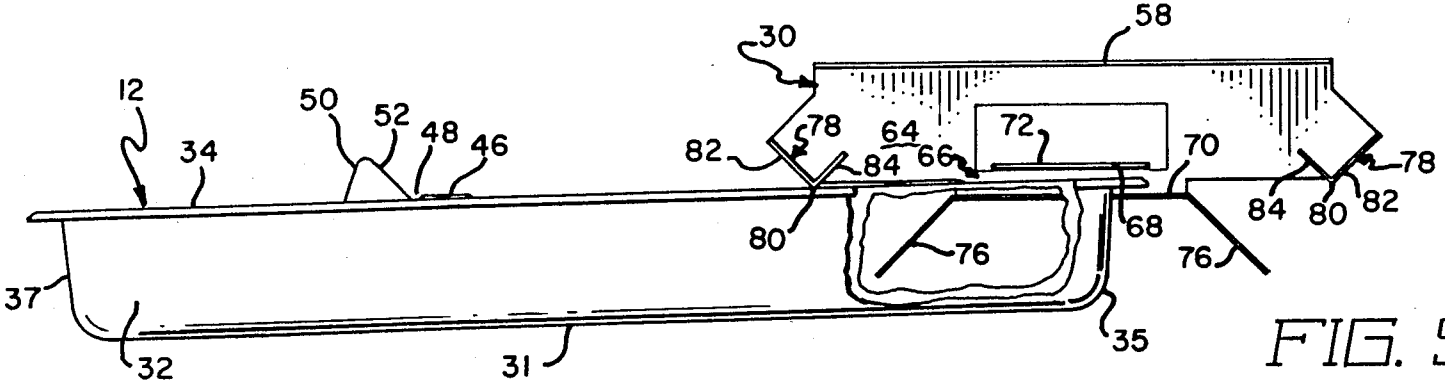
FIG. 5 is a partially broken-away side view of the drain pan being inserted or removed from a bracket.
Figure 6:
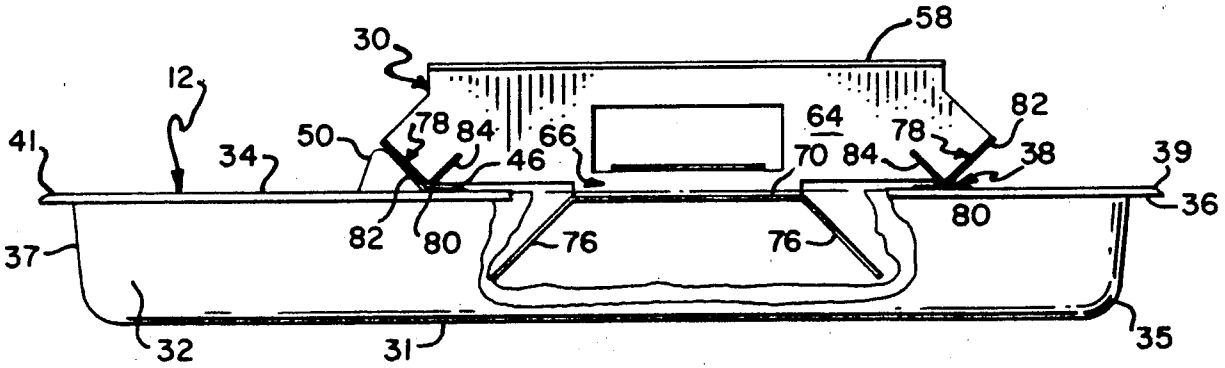
FIG. 6 is a partially broken-away side view of the drain pan in the operating position as supported by a bracket.
Figure 7:
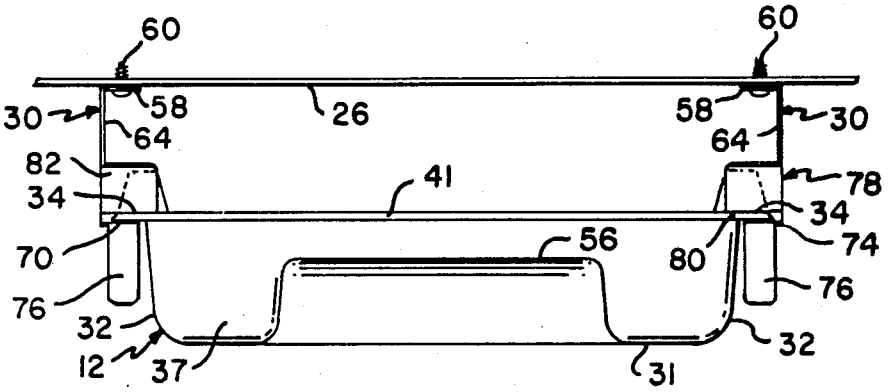
FIG. 7 is a front view of the drain pan supported by a pair of brackets.

Still referring to FIGS. 2, 5 and 6, drain pan mounting brackets 30 have top horizontal mounting plates 58 which, as shown in FIGS. 7 and 8, are secured to the underside of outer case bottom 26 by inserting screws 60 through screw holes 62, thereby suspending mounting brackets 30 from the underside of the outer case bottom 26. Vertical panels 64 extend downwardly to guide slots 66 that include a top horizontal panel guide 68 and a parallel-spaced guide support shelf 70. Drain pan mounting bracket 30 is a stamped metal part, and the top horizontal panel guide 68 of guide slot 66 is formed by cutting a flap 72 from the vertical panel 64 and bending it downwardly at a right angle. Guide support shelf 70 is formed by bending vertical panel 64 upwardly along bend line 74. At the front and back ends of guide support shelf 70 are downwardly inclined ramps 76. V-shaped tabs 78 or stops are formed by bending vertical panel 64 inwardly at the front and rear. Each V-shaped tab 78 has a nadir 80 or V point interconnecting an external sloped surface 82 with an internal sloped surface 84. As will become apparent, it is preferable that the nadirs 80 be located slightly below the plane of top horizontal panel guide 68.

Referring to FIG. 8, foam insulation 86 is positioned between the refrigerator compartment liner 88 and outer case bottom 26. Referring also to FIG. 7, a pair of drain pan mounting brackets 30 are fixed in parallel longitudinal alignment to the underside of outer case bottom 26 so that the brackets 30 are suspended therefrom. As shown best in FIG. 7, the separation between the corresponding vertical panels 64 of the pair of mounting brackets 30 is wide enough so that the outer edges of opposing rims 34 of drain pan 12 will fit therebetween with some tolerance. Also, the separation is small enough so that when one rim 34 is seated on one guide support shelf 70, the opposite rim 34 extends beyond the inner edge of the opposite guide support shelf 70. Because of the longitudinal symmetry of mounting bracket 30, the same part is used for both the left and right side of the pair of mounted brackets 30. As shown in FIG. 8, brackets 30 support drain pan 12 in the operating position with an air gap 90 or space between the bottom 31 of the drain pan 12 and condenser 16. Air gap 90 provides for free circulation of air across the top of condenser 16 thereby improving the thermal transfer from condenser 16 as contrasted with an arrangement with the drain pan 12 seated on condenser 16.

In operation, it is relatively easy to remove drain pan 12 and replace it to its mounting brackets 30. More specifically, it may be desirable to remove drain pan 12 from time to time for various reasons such as, for example, to move refrigerator 10 or clean condenser 16. In such case, the grill 92 as shown in FIG. 8 is first removed, and then handle 56 is used to pull drain pan 12 forwardly. As drain pan 12 is moved forward, the nadirs 80 of front and rear V-shaped tabs 78 on both left and right sides prevent drain pan 12 from tipping forward or rearward which could result in water spilling. Even as the rear of support rims 34 of drain pan 12 passes to the front of corresponding rear V-shaped tabs 78 as shown in FIG. 5, the top horizontal panel guide 68 and guide support shelf 70 continue to provide a guide slot 66 that prevents a drastic tip that would spill water. Finally, the drain pan 12 moves forward far enough so that it can be grasped by both hands and removed without spilling water.

Even though the drain pan 12 is mounted in a relatively awkward position in chamber 24 close to the floor, the alignment for replacing drain pan 12 is accomplished with relative ease. More specifically, the vertical alignment is provided by forward facing ramps 76. As the back end of drain pan 12 is moved rearwardly, the back rim 39 engages the forward facing ramps 76 which guide the back end upwardly to the plane of corresponding guide slots 66. Next, the rounded corners 36 of rims 34 and 39 assist in guiding drain pan 12 laterally for alignment into guide slots 66. FIG. 5 shows a partially broken-away view of drain pan 12 as it is being inserted or withdrawn into guide slots 66. Right rim 34 is seated on the guide support shelf 70 on the right bracket 30, and left rim 34 is seated on the support shelf 70 of the left bracket 30. In this position, the back end of drain pan 12 is fully supported on shelves 70, and the hand pushes rearwardly while supporting the front end. Top panel guide 68 prevents drain pan 12 from being too low at the front, and prepares the longitudinal attitude for inserting rims 34 under rear nadirs 80 as drain pan 12 moves rearwardly. The inward sloped surfaces 84 assist in guiding back rim 39 under rear V-shaped tabs 78 when drain pan 12 is inserted to that position. The rear nadirs 80 are lower than the horizontal plane of top horizontal panel guides 68, but there is still enough clearance so that drain pan 12 can slide rearwardly after rims 34 pass under rear nadirs 80.

FIG. 6 shows drain pan 12 in its most rearward and operating position suspended by mounting brackets 30. As drain pan 12 approaches this operating position, rear nadirs 80 slide up inclined surfaces 43 onto respective gripper pads 38, and front nadirs 80 glide up onto inclined surfaces 46. Finally, front nadirs 80 slide into valleys 48 or depressions, and bumpers 50 contact the forward external sloped surfaces 82 of V-shaped tabs 78 thereby preventing further movement of drain pan 12 toward the rear. More specifically, the external surfaces 82 of forward V-shaped tabs 78 function as stops when the respective shoulders 52 of bumpers 50 contact them at the operating position of drain pan 12. In this operating position as shown in FIGS. 6 and 8, drain pan 12 is securely and snugly engaged by mounting brackets 30 thereby preventing independent vibration between drain pan 12 and brackets 30 that could result in undesirable noise. More specifically, the dimensions of brackets 30 and drain pan 12 are such that there is in interference fit between rear nadirs 80 and gripper pads 38. Also, there is an interference fit between front nadirs 80, and valleys 48 whereby drain pan 12 is clamped tightly in the operating position. In other words, front and back nadirs 80 function as clamps exerting a downward force on respective gripper pads 38 and valleys 48, with the drain pan being supported on the underside of rims 34 therebetween by guide support shelves 70. The seating of front nadirs 80 into valleys 48 further prevents movement of pan 12 toward the front unless there is a minimum force exerted, such as by pulling on handle 56.

In the operating position as shown in FIGS. 6 and 8, the front V-shaped tabs or stops 78 positively locate drain pan 12 in the longitudinal or front-to-back direction, and guide slots 66 positively locate drain pan in the lateral direction. Accordingly, drain pan 12 is aligned to a predetermined location where the outlet 94 of drain hose 22 is directly above a portion of cone 33 as shown best in FIGS. 1 and 8. Accordingly, rather than dripping into water collected in pan 12, the water from drain hose 22 drips onto cone 33 and runs down the side of the cone into the collected water. Accordingly, with such arrangement, the noise of water dripping into water is eliminated. Another advantage of bumpers 50 is that they prevent backward installation of drain pan 12.

This concludes the description of the preferred embodiment. It will be apparent to one skilled in the art that many alterations and modifications are possible without departing from the spirit and scope of the invention. Accordingly, it is intended that the scope of the invention only be limited by the appended claims.

What is claimed is:

1. Apparatus for collecting water formed by melting ice during a refrigerator defrost cycle, comprising:

a drain pan comprising a bottom, side walls, a back wall, and a front wall; and means for supporting said drain pan in an elevated operating position for receiving said water formed by said defrost cycle, said supporting means comprising guide slots for slidably removing and replacing said drain pan, said supporting means further comprising means for preventing vibration noise from said drain pan in said operating position, said preventing means comprising means for clamping said drain pan to said supporting means.

2. The apparatus recited in claim 1 wherein said drain pan further comprises rims extending outwardly from said side walls, said guide slots being adapted for receiving said rims in sliding engagement.

3. The apparatus recited in claim 1 further comprising a stop for preventing said drain pan from being slid in said guide slots back past said operating position.

4. Apparatus for collecting water formed by melting ice during a refrigerator defrost cycle, comprising:

a drain pan comprising a bottom, side walls, a back wall, and a front wall;

means for supporting said drain pan in an elevated operating position for receiving said water formed by said defrost cycle, said supporting means comprising guide slots for slidably removing and replacing said drain pan, said supporting means further comprising means for clamping said drain pan in said operating position for preventing vibration noise;

said drain pan further comprising rims extending outwardly from said side walls, said guide slots being adapted for receiving said rims in sliding engagement; and said rims having pads and said clamping means comprising means for engaging said pans in an interference fit at said operating position.

5. Apparatus for collecting water formed by melting ice during a refrigerator defrost cycle, comprising:

a drain pan comprising a bottom, side walls, a back wall, and a front wall;

means for supporting said drain pan in an elevated operating position for receiving said water formed by said defrost cycle, said supporting means comprising guide slots for slidably removing and replacing said drain pan, said supporting means further comprising means for clamping said drain pan in said operating position for preventing vibration noise; and a drain hose for directing said water to said drain pan, said bottom of said drain pan having an upward protrusion directly below the outlet of said drain hose wherein water dripping from said drain hose drips onto said protrusion and then runs down into water collected in said drain pan.

6. Drain pan apparatus for collecting water formed by melting ice during a refrigerator defrost cycle, comprising:

a drain pan comprising a bottom, side walls having outwardly extending lips with raised pads, a back wall and a front wall; and a pair of spaced parallel longitudinal brackets for supporting said drain pan in an operating position for collecting said water, each of said brackets comprising a guide slot comprising a horizontal shelf for supporting a respective one of said lips in slidable engagement wherein said drain pan can be removed and replaced from said brackets by longitudinally sliding said lips of said pan along said horizontal shelf, each of said brackets further comprising clamps for engaging said pads in an interference fit in said operating position for preventing vibration noise between said pan and said brackets.

7. The apparatus recited in claim 6 wherein each of said guide slots further comprises a flap panel horizontally spaced above said horizontal shelf.

8. The apparatus recited in claim 7 wherein said clamps comprise forward and rearward V-shaped tabs having nadirs positioned below the plane of said flap panel.

9. The apparatus recited in claim 8 wherein said drain pan further comprises bumpers on said lips, said bumpers being positioned for contacting said forward V-shaped tabs at the operating position of said drain pan for providing a stop to prevent said drain pan from being slid inwardly on said horizontal shelves past said operating position.

10. The apparatus recited in claim 6 further comprising a downwardly inclined ramp extending forward from each of said horizontal shelves for guiding said lips up into said guide slots.

11. The apparatus recited in claim 6 wherein said drain pan further comprises a cone for providing a drip area for said water which is above the level of water collected in said drain pan.

12. The apparatus recited in claim 6 wherein said brackets suspend said drain pan in an elevated position with an air gap underneath.

* * * * *